United States Patent [19]

Boyars

[11] 4,124,368

[45] Nov. 7, 1978

[54] INSENSITIVE AMMONIUM NITRATE

[75] Inventor: Carl Boyars, Silver Spring, Md.

[73] Assignee: The United States of America as represented by the Secretary of the Navy, Washington, D.C.

[21] Appl. No.: 728,819

[22] Filed: Oct. 1, 1976

[51] Int. Cl.[2] ..... C06B 45/00

[52] U.S. Cl. ..... 71/59; 149/46; 149/61; 149/108.8; 149/2; 423/396

[58] Field of Search ..... 149/2, 41, 46, 61, 108.8; 71/59; 423/396

[56] References Cited

U.S. PATENT DOCUMENTS 3,684,596 8/1972 Vercauteren ..... 149/61 X

*Primary Examiner*—Stephen J. Lechert, Jr.
*Attorney, Agent, or Firm*—R. S. Sciascia; A. L. Branning; R. D. Johnson

[57] ABSTRACT

The danger of the accidental detonation of large masses of commercial ammonium nitrate during handling and storage under normal climatic conditions is reduced by replacing the ammonium nitrate with a solid solution of potassium nitrate in form III ammonium nitrate wherein the potassium nitrate constitutes from more than zero to less than 50 weight percent of the solid solution.

10 Claims, No Drawings

INSENSITIVE AMMONIUM NITRATE

BACKGROUND OF THE INVENTION

This invention relates to ammonium nitrate and more particularly to methods of preventing the accidental detonation of ammonium nitrate.

It is well known that ammonium nitrate is a hazardous material to manufacture on an industrial scale, to handle commercially in large amounts, and to store in great masses in commercial warehouses and storage bins, especially for relatively long periods of time. As those skilled in the art have been aware, there have been unexplained accidents and explosions in the manufacture, handling, and storage of ammonium nitrate.

It was known that at temperatures ranging from about −18° C. to the transition point occurring at 32.3° C. the stable crystal form of ammonium nitrate is an orthorhombic bipyramidal form of specific gravity 1.715, designated by the Roman numeral IV. Between the transition point occurring at 32.3° C. and the other transition point occurring at 84° C. the stable crystal form is orthorhombic and of specific gravity 1.654, designated by the Roman numeral III. Lastly, between 84° C. and 125° C. the stable crystal form is tetragonal, designated by the Roman numeral II.

It was known in "Zur Sensibilität von Ammoniumitratengegen Detonationsstoss," *Chemiker Zeitung*, Volume 96 (1972), pages 449–455 that the detonation sensitivity of ammonium nitrate to shock increases seriously after exposure to a few temperature cycles through the 32.3° C. (90° F.) transition point. Stabilizing agents like magnesium nitrate or boric acid/ammonium phosphate/ammonium sulfate, which have been added to ammonium nitrate to prevent cracking, caking, and reduction in the bulk density of the prills, also prevent increases in the sensitivity of the ammonium nitrate. These additives accomplish this by tying up the moisture which is necessary for the 32.3° C. phase change from ammonium nitrate form III to form IV to occur. However, once such stabilizing agents become saturated, they can no longer function as phase stabilizing agents, "growth" and increased sensitivity then occur as with unstabilized ammonium nitrate. Thus, spraying with 0.5 percent water (an amount that the hygroscopic ammonium nitrate can readily take up from the atmosphere) followed by a few temperature cycles gave a product that detonated completely, even for the best stabilized ammonium nitrate.

SUMMARY OF THE INVENTION

Accordingly, one object of this invention is to prevent the accidental detonation of the large masses of ammonium nitrate which are handled and stored commercially.

Another object of this invention is to provide a method of treating ammonium nitrate which will prevent the ammonium nitrate from becoming detonation sensitive upon cycling through the 32.3° C. transition point.

A further object of this invention is to provide a method of preventing increases in the detonation sensitivity of ammonium nitrate which will not be rendered inoperative by moisture absorbed from the air.

Still another object of this invention is to prevent increases in the porosity of the ammonium nitrate when it is temperature cycled through the 32.3° C. (90° F.) phase change region.

These and other objects of this invention are accomplished by replacing the ammonium nitrate with a solid solution of potassium nitrate in form III ammonium nitrate wherein said potassium nitrate constitutes from more than zero to less than 50 weight percent of the solid solution.

DESCRIPTION OF THE PREFERRED EMBODIMENT

As noted above, large masses of ammonium nitrate which are handled and stored commercially become detonation sensitive when temperature cycled through the 32.3° C. (90° F.) transition point. The present inventor realized that this increase in the detonation sensitivity of ammonium nitrate is due to increased porosity of the ammonium nitrate prills which results from this cycling. This can be prevented by adding potassium nitrate to form III ammonium nitrate to produce a solid solution of potassium nitrate in form III ammonium nitrate. The presence of potassium nitrate lowers the form IV to form III transition temperature of ammonium nitrate. See J. Morand, Ann. Chim (Paris) (1955) 10, T. Seiyama, N. Yamazoe, J. Crystal Growth, (1968) 2, 255; and R. V. Coates, G. D. Woodard, J. Chem. Soc. (1965) 2135.

Solid solutions of potassium nitrate in ammonium nitrate are easily prepared in the same equipment used for commercial manufacture of ammonium nitrate prills, with negligible modification of the production process. The potassium nitrate is added to the molten ammonium nitrate before prilling, and the resulting solid solution prills are visually indistinguishable from ordinary ammonium nitrate prills. Pilot lots, totaling about 25,000 pounds, have been manufactured for the Naval Surface Weapons Center, White Oak Laboratory by Gulf Chemical and Ross Thermal Systems. Other methods of producing potassium nitrate in form III ammonium nitrate solid solutions include the co-crystalization of ammonium nitrate with potassium nitrate (Roffey et al, British Pat. No. 573,147, Nov. 8, 1945) and the addition of potassium nitrate to ammonium nitrate followed by heating the solids at 32°–100° C. (J. Whetstone, Canadian Journal of Research, 26B, 499 (1948) and J. Whetstone et al, U.S. Pat. No. 2,590,054).

It should be noted that the potassium nitrate in form III ammonium nitrate in a solid solution and not just a mixture of the two salts. Solid solution is usually defined as a solid chemical compound in which one ion has been partially replaced over a continuously variable range by another of similar radius, the crystal space-group remaining that of the original pure compounds.

Potassium nitrate is added until the form III to form IV ammonium nitrate transition temperature is below the temperature to which the ammonium nitrate will be exposed. The temperature range over which form IV ammonium nitrate can exist is steadily decreased as the potassium nitrate content of the solid potassium nitrate in form III ammonium nitrate solution goes from zero to 15 weight percent; similarly, the rate of transformation of form III and to form IV ammonium nitrate is decreased with increasing potassium nitrate content of the solid solution. Thus, any concentration of potassium nitrate above zero weight percent will have some effect on reducing the probability of adverse phase changes and the consequent increased danger of explosions. With potassium nitrate present in solution, the temperature must be reduced below 32.3° C. (90° F.) and maintained there for a longer time for the form III to form IV transition to take place. If the potassium nitrate content of the solid solution is 10 weight percent or more, form IV ammonium nitrate will not exist at temperatures above 0° C. Moreover, if the potassium nitrate content of the potassium nitrate-form III ammonium nitrate solid solution is 15 weight percent or more, the form III to form IV ammonium nitrate transition is completely eliminated. In view of this, potassium nitrate constitutes from more than zero to less than 50, preferably from 10 to less than 50, and more preferably from 15 to less than 50 weight percent of the potassium nitrate-form III ammonium nitrate solution.

The maximum amount of potassium nitrate which may be used is determined by how the ammonium nitrate is to be used. The present invention is particularly suited for ammonium nitrate which is used as fertilizer. For example, a solid solution containing 10 percent by weight of potassium nitrate and 90 percent by weight ammonium nitrate contains 32.9 percent by weight percent of nitrogen as compared with the 35 weight percent of nitrogen present in pure ammonium nitrate or 34.5 weight percent of nitrogen in most commercial ammonium nitrates. In addition, this solid solution contains 4.7 percent by weight $K_2O$, a valuable fertilizing ingredient. Higher concentrations of potassium nitrate may also be used in the solid solution, especially where a higher potash content is desired in the fertilizer. Taking into account this use, the preferred and more preferred ranges of potassium nitrate content in the potassium nitrate — form III ammonium nitrate solid solution are from 10 to 20 weight percent and from 15 to 17 weight percent, respectively.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. The method of reducing the danger of the accidental detonation of large masses of commercial ammonium nitrate during handling and storing under normal climatic conditions comprising substituting a solid solution of potassium nitrate in form III ammonium nitrate for said ammonium nitrate wherein the potassium nitrate constitutes from more than zero to less than 50 weight percent of the solid solution.

2. The method of claim 1 wherein potassium nitrate constitutes from 10 to less than 50 weight percent of the solid solution.

3. The method of claim 2 wherein potassium nitrate constitutes from 15 to less than 50 weight percent of the solid solution.

4. The method of claim 1 wherein potassium nitrate constitutes from 10 to 20 weight percent of the solid solution.

5. The method of claim 4 wherein potassium nitrate constitutes from 15 to 17 weight percent of the solid solution.

6. The method of reducing the danger of the accidental detonation of large masses of commercial ammonium nitrate fertilizer during handling and storing under normal climatic conditions comprising substituting a solid solution of potassium nitrate in form III ammonium nitrate for said ammonium nitrate wherein the potassium nitrate constitutes from more than zero to less than 50 weight percent of the solid solution.

7. The method of claim 6 wherein potassium nitrate constitutes from 10 to less than 50 weight percent of the solid solution.

8. The method of claim 7 wherein potassium nitrate constitutes from 15 to less than 50 weight percent of the solid solution.

9. The method of claim 6 wherein potassium nitrate constitutes from 10 to 20 weight percent of the solid solution.

10. The method of claim 9 wherein potassium nitrate constitutes from 15 to 17 weight percent of the solid solution.

* * * * *